US008277199B2

(12) United States Patent
Yoo et al.

(10) Patent No.: US 8,277,199 B2
(45) Date of Patent: Oct. 2, 2012

(54) APPARATUS AND METHOD FOR CONTROLLING OPERATION OF LINEAR COMPRESSOR

(75) Inventors: Jae-Yoo Yoo, Gyeonggi-Do (KR); Ji-Won Sung, Seoul (KR); Chel-Woong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1133 days.

(21) Appl. No.: 12/159,316

(22) PCT Filed: Dec. 28, 2006

(86) PCT No.: PCT/KR2006/005839

§ 371 (c)(1),
(2), (4) Date: Jun. 26, 2008

(87) PCT Pub. No.: WO2007/078114

PCT Pub. Date: Jul. 12, 2007

(65) Prior Publication Data

US 2009/0010766 A1 Jan. 8, 2009

(30) Foreign Application Priority Data

Dec. 30, 2005 (KR) ..... 10-2005-0136134

(51) Int. Cl.
*F04B 49/06* (2006.01)

(52) U.S. Cl. ..... 417/44.11

(58) Field of Classification Search ..... 318/119, 318/135, 38; 417/44.11, 416, 44.1, 212, 417/22, 42

See application file for complete search history.

(56) References Cited

U.S. PATENT DOCUMENTS 5,600,553 A * 2/1997 Kawasaki et al. ..... 700/50
6,520,746 B2 2/2003 Yoo et al.
6,832,898 B2 12/2004 Yoshida et al.
6,851,934 B2 2/2005 Yoo et al.
2003/0026702 A1 * 2/2003 Yoo et al. ..... 417/44.11

(Continued)

FOREIGN PATENT DOCUMENTS

CN 1400388 A 3/2003

(Continued)

OTHER PUBLICATIONS

European Search Report dated Mar. 3, 2009.

(Continued)

*Primary Examiner* — Devon Kramer
*Assistant Examiner* — Bryan Lettman
(74) *Attorney, Agent, or Firm* — Ked & Associates LLP

(57) ABSTRACT

An apparatus and method for controlling an operation of a reciprocating compressor are disclosed in which a frequency is variably controlled to uniformly maintain a phase difference between current and stroke, a load is determined with a size of frequency at a point of time when the phase difference between the current and the stroke is uniformly maintained, and capacity is varied according to the determined load, to thus improve an operation efficiency. The apparatus for controlling an operation of a reciprocating compressor includes: a control unit for detecting a phase difference between current and stroke and outputting a frequency variable signal or a frequency detect signal based on the detected phase difference; a load detecting unit for detecting a current operation load according to the frequency detect signal; and a stroke reference value determining unit for determining a stroke reference value corresponding to the detected load.

15 Claims, 5 Drawing Sheets

U.S. PATENT DOCUMENTS

| | | | | |
|---|---|---|---|---|
| 2003/0108430 | A1 * | 6/2003 | Yoshida et al. | 417/44.11 |
| 2003/0180151 | A1 | 9/2003 | Jeun | 417/44.11 |
| 2004/0071556 | A1 | 4/2004 | Sung et al. | |
| 2004/0239266 | A1 | 12/2004 | Lee et al. | 318/119 |
| 2005/0031470 | A1 | 2/2005 | Lee | |
| 2007/0110600 | A1 | 5/2007 | Park et al. | |
| 2007/0134116 | A1 | 6/2007 | Park et al. | |
| 2007/0152517 | A1 | 7/2007 | Park et al. | |
| 2007/0241697 | A1 | 10/2007 | Sung et al. | |
| 2007/0241698 | A1 | 10/2007 | Sung et al. | |

FOREIGN PATENT DOCUMENTS

| | | |
|---|---|---|
| CN | 1400389 A | 3/2003 |
| CN | 1424506 A | 6/2003 |
| JP | 2003-176788 | 6/2003 |
| KR | 2002-0024897 | 4/2002 |
| KR | 2003-0012262 | 2/2003 |
| KR | 10-2004-0033721 | 4/2004 |
| KR | 10-2005-0016863 | 2/2005 |

OTHER PUBLICATIONS

English language Abstract of KR 2003-0012262, Feb. 12, 2003.
English language Abstract of KR 2002-0024897, Apr. 3, 2002.
English language Abstract of KR 10-2004-0033721, Apr. 28, 2004.
English language Abstract of KR 10-2005-0016863, Feb. 21, 2005.
English language Abstract of JP 2003-176788, Jun. 27, 2003.

* cited by examiner

APPARATUS AND METHOD FOR CONTROLLING OPERATION OF LINEAR COMPRESSOR

BACKGROUND OF THE INVENTION

1. Field of the Invention

The present invention relates to a compressor and, more particularly, to an apparatus and method for controlling an operation of a reciprocating compressor.

2. Description of the Related Art

In general, a reciprocating compressor is operated to suck, compress and discharge a refrigerant gas by reciprocally and linearly moving a piston in a cylinder provided therein.

The reciprocating compressor is divided into a compressor using a recipro method and a compressor using a linear method according to how the piston is driven.

In the compressor using the recipro method, a crank shaft is coupled with a rotary motor and the piston is coupled with the crank shaft, to thus change a rotating force of the rotary motor to a reciprocating motion.

In the compressor using the linear method, the piston connected with an actuator of a linear motor is linearly moved.

The reciprocating compressor using the linear method does not have such a crank shaft for changing the rotational motion into the linear motion, causing no frictional loss by the crank shaft, so it has high compression efficiency compared with a general compressor.

The reciprocating compressor can be employed for a refrigerator or an air-conditioner to control cooling capacity of the refrigerator or the air-conditioner by varying a compression ratio of the reciprocating compressor which can be varied by changing voltage inputted to the motor of the reciprocating compressor.

Thus, when the reciprocating compressor is employed for the refrigerator or the air-conditioner, the cooling capacity can be controlled by varying the compression ratio of the reciprocating compressor by varying a stroke voltage inputted to the reciprocating compressor. Herein, the stroke refers to a distance between a top dead center and a bottom dead center of the piston.

The reciprocating compressor according to the related art will now be described with reference to FIG. 1.

FIG. 1 is a schematic block diagram showing the construction of an apparatus for controlling an operation of the reciprocating compressor according to the related art.

As shown in FIG. 1, the related art apparatus for controlling an operation of the reciprocating compressor includes: a current detection unit 4 for detecting current applied to a motor (not shown) of a reciprocating compressor 6; a voltage detection unit 3 for detecting voltage applied to the motor; a stroke calculation unit 5 for calculating a stroke estimate value of the reciprocating compressor 6 based on the detected current and voltage values and a parameter of the motor; a comparing unit 1 for comparing the calculated stroke estimate value with a pre-set stroke reference value and outputting a difference value according to the comparison result; and a stroke control unit 2 for controlling an operation (stroke) of the compressor 6 by varying the voltage applied to the motor by controlling a turn-on period of a triac (not shown) connected in series to the motor according to the difference value.

The operation of the apparatus for controlling an operation of the reciprocating compressor will now be described with reference to FIG. 1.

First, the current detect unit 4 detects current applied to the motor (not shown) of the compressor 6 and outputs the detected current value to the stroke calculation unit 5.

At this time, the voltage detection unit 3 detects the voltage applied to the motor and outputs the detected voltage value to the stroke calculation unit 5.

The stroke calculation unit 5 calculates a stroke estimate value (X) of the compressor by substituting the detected current and voltage values and the parameter of the motor to equation (1) shown below and applies the calculated stroke estimate value (X) to the comparing unit 1:

$$X = \frac{1}{\alpha}\int (V_M - Ri - L\dot{i})dt \tag{1}$$

wherein 'R' is a motor resistance value, 'L' is a motor inductance value, a is a motor constant, $V_M$ is a voltage value applied to the motor, 'i' is a current value applied to the motor, and $\dot{i}$ is a time change rate of the current applied to the motor. Namely, $\dot{i}$ is a differential value (di/dt) of 'i'.

Thereafter, the comparing unit 1 compares the stroke estimate value and the stroke reference value and applies a difference value according to the comparison result to the stroke control unit 2.

The stroke control unit 2 controls stroke of the compressor 6 by varying the voltage applied to the motor of the compressor 6 based on the difference value.

This operation will now be described with reference to FIG. 2.

FIG. 2 is a flow chart illustrating the processes of a method for controlling an operation of the reciprocating compressor according to the related art.

First, when the stroke estimate value is applied to the comparing unit 1 by the stroke calculation unit 5 (SP1), the comparing unit 1 compares the stroke estimate value and the pre-set stroke reference value (SP2) and outputs the difference value according to the comparison result to the stroke control unit 2.

When the stroke estimate value is smaller than the stroke reference value, the stroke control unit 2 increases the voltage applied to the motor to control the stroke of the reciprocating compressor (SP3), and when the stroke estimate value is greater than the stroke reference value, the stroke control unit 2 reduces the voltage applied to the motor (SP4).

When the voltage applied to the motor is increased or reduced, the triac (not shown) electrically connected with the motor controls the turn-on period and applies the voltage to the motor.

The stroke reference value differs depending on a size of a load of the reciprocating compressor. Namely, when the load is large, the stroke reference value is increased not to reduce the stroke of the piston to thus prevent degradation of cooling capacity. Conversely, when the load is small, the stroke reference value is reduced not to increase the stroke of the piston and thus prevent an increase of the cooling capacity and generation of collision of the piston and the cylinder due to an excessive stroke (over-stroke).

The related art apparatus for controlling the operation of the reciprocating compressor estimates the stroke by using a motor parameter (a), resistance (R) and reactance (L), and controls the stroke by using the stroke estimate value.

However, in estimating the stroke, an error is generated due to the motor parameter and a component deviation, making it difficult to precisely control the stroke.

BRIEF DESCRIPTION OF THE INVENTION

Therefore, an object of the present invention is to provide an apparatus and method for controlling an operation of a reciprocating compressor whereby a frequency is variably controlled to uniformly maintain a phase difference between current and stroke, a load is determined with a size of frequency at a point of time when the phase difference between the current and the stroke is uniformly maintained, and capacity is varied according to the determined load.

To achieve these and other advantages and in accordance with the purpose of the present invention, as embodied and broadly described herein, there is provided an apparatus for controlling an operation of a reciprocating compressor including: a control unit for detecting a phase difference between current and stroke and outputting a frequency variable signal or a frequency detect signal based on the detected phase difference; a load detecting unit for detecting a current operation load according to the frequency detect signal; a stroke reference value determining unit for determining a stroke reference value corresponding to the detected load; a PWM (Pulse Width Modulation) signal generating unit for generating a PWM signal based on a difference between the determined stroke reference value and a current stroke; and an inverter for varying voltage and frequency applied to a motor according to the PWM signal.

To achieve the above object, there is also provided an apparatus for controlling an operation of a reciprocating compressor including: a current detection unit for detecting current applied to a linear motor; a voltage detection unit for detecting voltage applied to the linear motor; a stroke detecting unit for detecting stroke with the detected current and voltage; a control unit for calculating a current speed by using the detected stroke and outputting a frequency variable signal or a frequency detect signal based on a phase difference between the calculated current speed and the current; a load detecting unit for detecting a current operation load according to the frequency detect signal; a stroke reference value determining unit for determining a stroke reference value corresponding to the detected load; a PWM signal generating unit for generating a PWM signal based on a difference between the determined stroke reference value and the current stroke; and an inverter for varying voltage and frequency applied to a motor according to the PWM signal.

To achieve the above object, there is also provided a method for controlling an operation of a reciprocating compressor including: operating the reciprocating compressor at a capacity that corresponds to a certain stroke reference value; detecting voltage and current applied to a motor and calculating stroke by using the detected voltage and detected current; detecting a phase difference between the stroke and the current; and comparing the detected phase difference and a reference phase difference, and varying an operation capacity based on the comparison result.

To achieve the above object, there is also provided a method for controlling an operation of a reciprocating compressor including: operating the reciprocating compressor at a capacity that corresponds to a certain stroke reference value; detecting voltage and current applied to a motor and calculating stroke by using the detected voltage and the detected current; calculating speed by using the calculated stroke and detecting a phase difference between the calculated speed and the current; and comparing the detected phase difference and a reference phase difference and varying an operation capacity based on the comparison result.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

An apparatus and method for controlling an operation of a reciprocating compressor by which a frequency is variably controlled to obtain a uniform phase difference between current and stroke, and a load is determined with a size of frequency at a point of time when the phase difference between the current and the stroke is uniformly maintained, and capacity is varied according to the determined load, to thereby improve an operation efficiency of a reciprocating compressor, according to an exemplary embodiment of the present invention will now be described with reference to the accompanying drawings.

The apparatus and method for controlling an operation of a reciprocating compressor employing an inverter according to the present invention is based upon such recognition that a size of a load can be recognized by using an operation frequency at a point of time when a phase difference between current and stroke or a phase difference between speed and stroke is uniform (constant).

Namely, the operation frequency increases when a load at the same stroke increases, and a required cooling capacity satisfies a proportional relationship according to a load size, and accordingly, the load size can be accurately detected by the operation frequency.

The present invention is provided to accurately detect the load.

Figure 1:
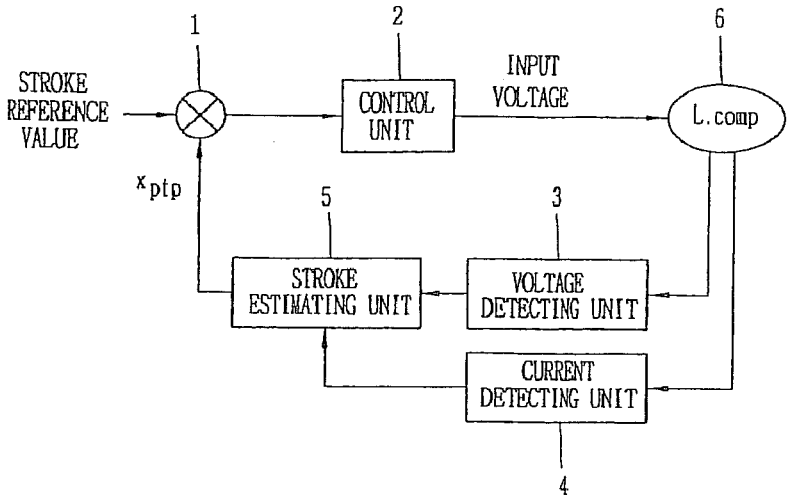
FIG. 1 RELATED ART
FIG. 1 is a schematic block diagram showing an apparatus for controlling an operation of a reciprocating compressor according to the related art.
Figure 2:
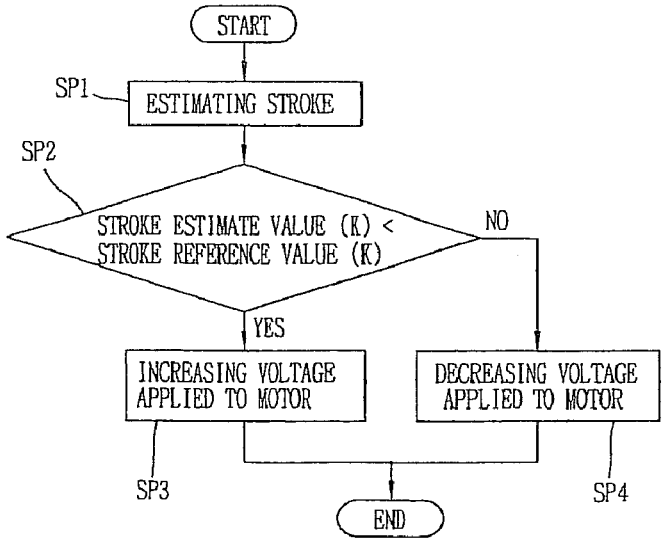
FIG. 2 RELATED ART
FIG. 2 is a flow chart illustrating the processes of a method for controlling an operation of the reciprocating compressor according to the related art.
Figure 3:
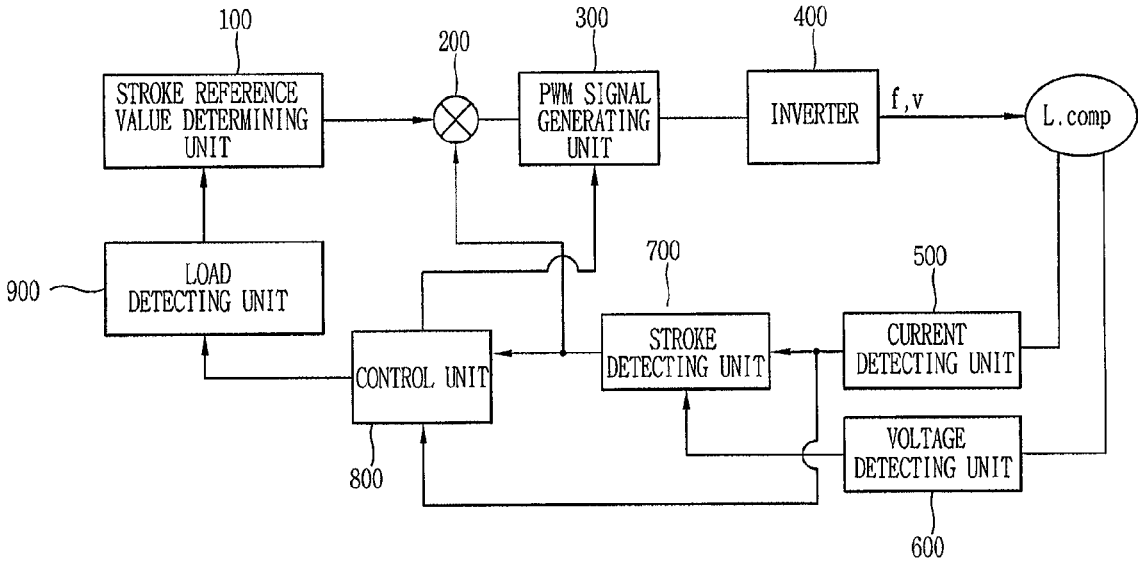
FIG. 3 is a schematic block diagram showing the construction of an apparatus for controlling an operation of a reciprocating compressor according to the present invention.

FIG. 3 is a schematic block diagram showing the construction of an apparatus for controlling an operation of a reciprocating compressor according to the present invention.

As shown in FIG. 3, the apparatus for controlling an operation of a reciprocating compressor includes a stroke reference value determining unit 100, a comparator 200, a PWM (Pulse Width Modulation) signal generating unit 300, an inverter 400, a current detecting unit 500, a voltage detecting unit 600, a stroke detecting unit 700, a control unit 800 and a load detecting unit 900.

The current detecting unit 500 detects current of a motor of a reciprocating compressor, and the voltage detecting unit 600 detects voltage of the motor of the reciprocating compressor.

The stroke detecting unit 700 calculates stroke by using the detected current and the detected voltage.

The control unit 800 detects a phase difference between the detected current and the stroke, and outputs a frequency variable signal or a frequency detect signal based on the detected phase difference.

Namely, when the detected phase difference is the same as a reference phase difference, the control unit 800 outputs a frequency detect signal, and if the detected phase difference is not equal to the reference phase difference, the control unit 800 outputs the frequency variable signal.

The PWM signal generating unit 300 generates a PWM signal for varying frequency of voltage applied to the motor based on the frequency variable signal, and the inverter 400 varies voltage and frequency applied to the motor of the reciprocating compressor according to the PWM signal.

The load detecting unit 900 detects a load based on the frequency detect signal outputted from the control unit 800.

Here, the load detecting unit 900 may include a storage unit (not shown) in which respective load size values corresponding to each frequency are previously stored according to experimentation. The load detecting unit 900 selects, from the storage unit, a size of a load corresponding to the frequency detect signal, and the selected size of the load is detected as the current load.

The stroke reference value determining unit 100 determines a stroke reference value according to the load detected by the load detecting unit 900.

Here, the stroke reference value determining unit 100 includes a stroke storage unit (not shown) in which each stroke value corresponding to a size of a load is previously stored according to experimentation. The stroke reference value determining unit 100 selects a stroke value corresponding to a size of the load from the stroke storage unit (not shown) and determines the selected stroke value as the stroke reference value.

Figure 4:
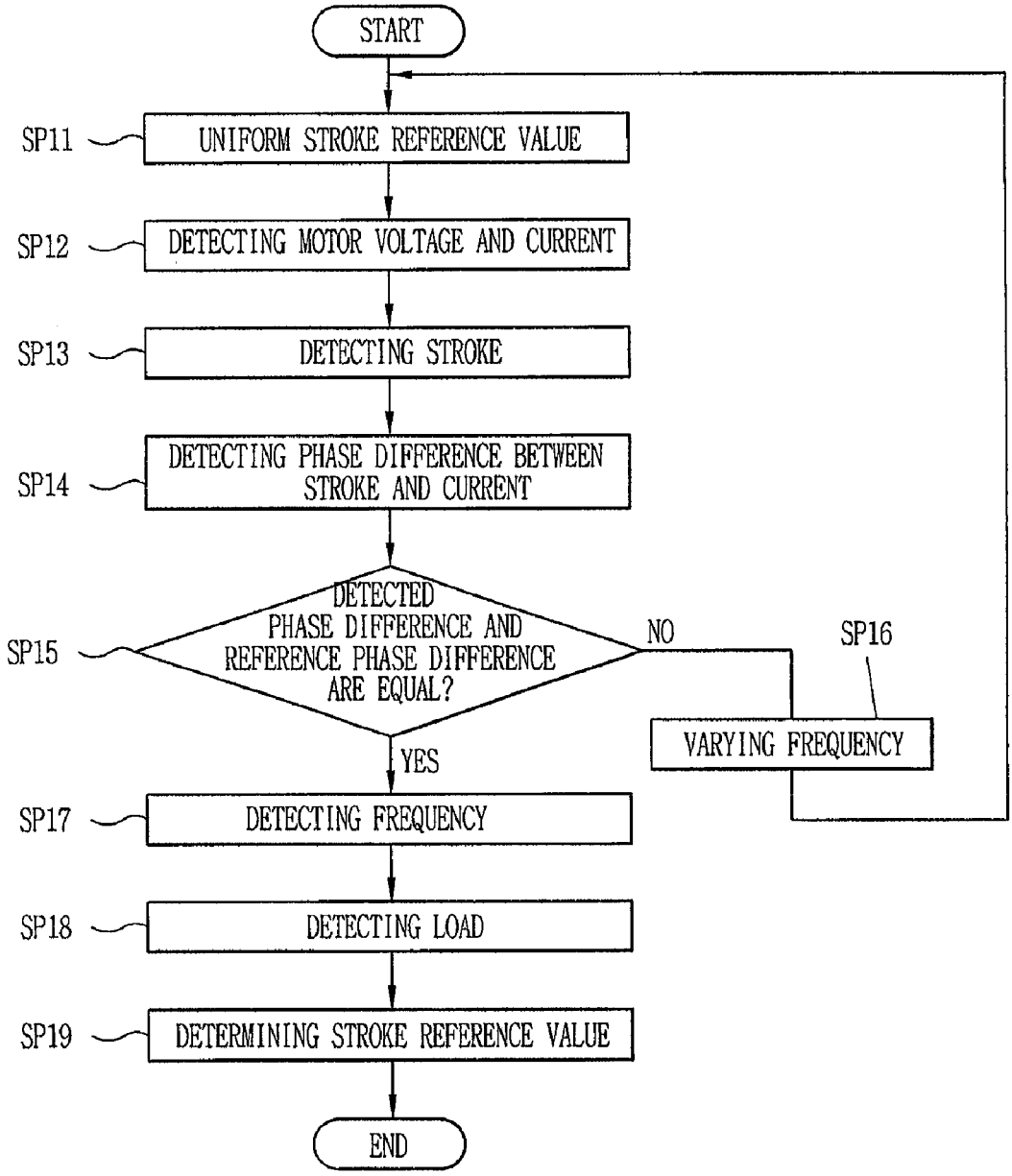
FIG. 4 is a flow chart illustrating the processes of a method for controlling an operation of the reciprocating compressor according to the present invention.

The operation of the present invention will now be described with reference to FIG. 4.

First, it is assumed that the reciprocating compressor is operated with a certain stroke reference value (SP11).

In this state, the current detecting unit 500 detects current of the motor of the reciprocating compressor, and the voltage detecting unit 600 detects voltage of the motor of the reciprocating compressor (SP12).

Thereafter, the stroke detecting unit 700 calculates stroke by using the detected current and the detected voltage (SP13).

And then, the control unit 800 detects a phase difference between the detected current and stroke (SP14), and outputs a frequency variable signal or a frequency detect signal based on the detected phase difference (SP16~SP19).

Namely, the control unit 800 compares the phase difference between the stroke and the current with a reference phase difference (about 90°), and if the detected phase difference is not equal to the reference phase difference, the control unit 800 varies an operation frequency (SP16).

Here, if the phase difference between the detected stroke and the current is greater than the reference phase difference, the control unit 800 reduces the operation frequency, whereas if the phase difference between the detected stroke and the current is smaller than the reference phase difference, the control unit increases the operation frequency.

The control unit 800 reduces the operation frequency by decreasing a duty rate of the PWM signal that switches a switching element (not shown) of the inverter 400, and increases the operation frequency by increasing the duty rate of the PWM signal.

Conversely, if the detected phase difference is equal to the reference phase difference, the control unit 800 detects a current operation frequency (SP17), and the load detecting unit 900 detects a size of a load according to the detected operation frequency (SP18).

Namely, the load detecting unit 900 detects a size of a load corresponding to the detected operation frequency from the storage unit (not shown) that stores loads corresponding to each operation frequency.

Thereafter, the stroke reference value determining unit 100 selects stroke corresponding to the size of the load from the stroke storage unit (not shown), and determines the selected stroke as the stroke reference value (SP19).

Namely, the stroke reference value determining unit 100 selects the stroke corresponding to the detected load from the storage unit (not shown) that previously stores the strokes corresponding to sizes of each load.

For example, if the load is determined as it is, the stroke reference value determining unit 100 selects stroke of a full cooling capacity, if the load is determined to be medium, the stroke reference value determining unit 100 selects stroke of 80% of the full cooling capacity, and if the load is determined to be small, the stroke reference value determining unit 100 selects stroke of 60% of full cooling capacity.

The comparator 200 obtains a difference value between the stroke reference value and the stroke, and the PWM signal generating unit 300 generates a PWM signal corresponding to the difference value and applies it to the inverter 400. Then, the inverter 400 varies frequency and voltage according to the PWM signal and applies it to the motor of the reciprocating compressor.

That is, in the present invention, the frequency is variably controlled to make a phase difference between the current and the stroke uniform, the load is determined based on a size of a frequency at a point of time at which the phase difference between the current and the stroke is uniformly maintained, and the operation capacity is varied according to the determined load, whereby the cooling capacity of an equipment employing an air-conditioning system (e.g., a refrigerator or an air-conditioner) can be easily varied.

Figure 5:
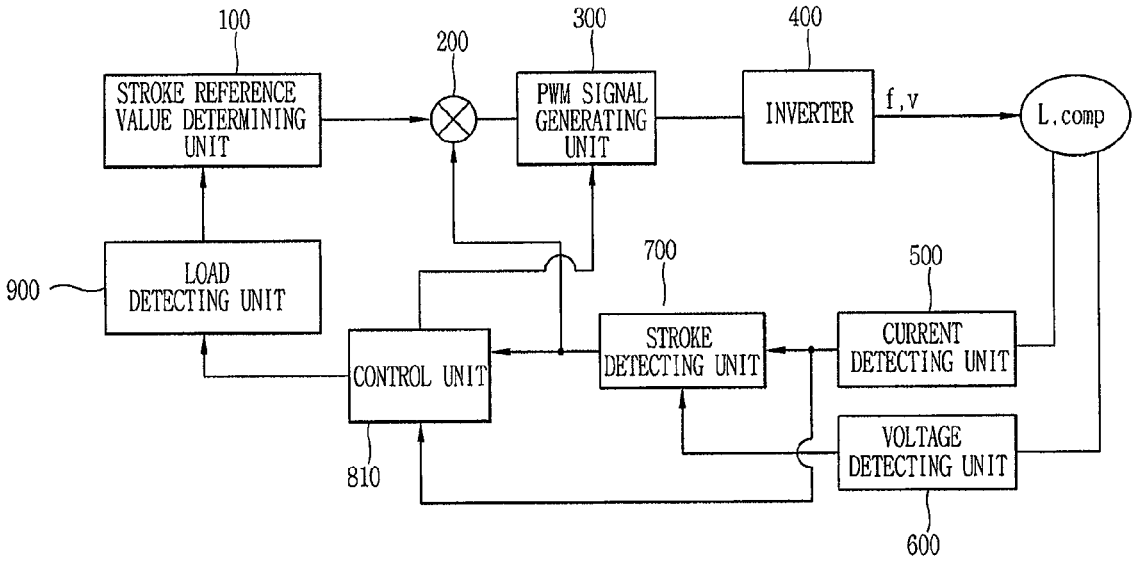
FIG. 5 is a schematic block diagram showing the construction of an apparatus for controlling an operation of a reciprocating compressor according to the present invention.

FIG. 5 is a schematic block diagram showing the construction of an apparatus for controlling an operation of a reciprocating compressor according to the present invention.

As shown in FIG. 5, the apparatus for controlling an operation of a reciprocating compressor includes a stroke reference value determining unit 100, a comparator 200, a PWM signal generating unit 300, an inverter 400, a current detecting unit 500, a voltage detecting unit 600, a stroke detecting unit 700, a control unit 810 and a load detecting unit 900.

The current detecting unit 500 detects current of a motor of a reciprocating compressor, and the voltage detecting unit 600 detects voltage of the motor of the reciprocating compressor.

The stroke detecting unit 700 detects stroke by using the detected current and the detected voltage.

The control unit 810 calculates speed by using the stroke which has been detected by the stroke detecting unit 700, obtains a phase difference between the calculated speed and the current, compares the detected phase difference with a reference phase difference, and outputs a frequency variable signal or a frequency detect signal according to the comparison result.

Namely, when the detected phase difference between the speed and the current is equal to the reference phase difference, the control unit 810 outputs the frequency detect signal, and if the detected phase difference is not equal to the reference phase difference, the control unit 810 outputs the frequency variable signal.

Here, obtaining the speed of the reciprocating compressor by using the stroke is a known art.

The PWM signal generating unit 300 generates a PWM signal for varying frequency of voltage applied to the motor based on the frequency variable signal, and the inverter 400 varies the voltage and the frequency applied to the motor of the reciprocating compressor according to the PWM signal.

The load detecting unit 900 detects a load based on the frequency detect signal outputted from the control unit 810.

Here, the load detecting unit 900 may include a storage unit (not shown) in which respective load size values corresponding to each frequency are previously stored according to experimentation. The load detecting unit 900 selects, from the storage unit, a size of a load corresponding to the frequency detect signal, and the selected size of the load is detected as the current load.

The stroke reference value determining unit 100 determines a stroke reference value according to the load detected by the load detecting unit 900.

Here, the stroke reference value determining unit 100 includes a stroke storage unit (not shown) in which each stroke value corresponding to a size of a load is previously stored according to experimentation. The stroke reference value determining unit 100 selects a stroke value corresponding to a size of the load from the stroke storage unit (not shown) and determines the selected stroke value as the stroke reference value.

Figure 6:
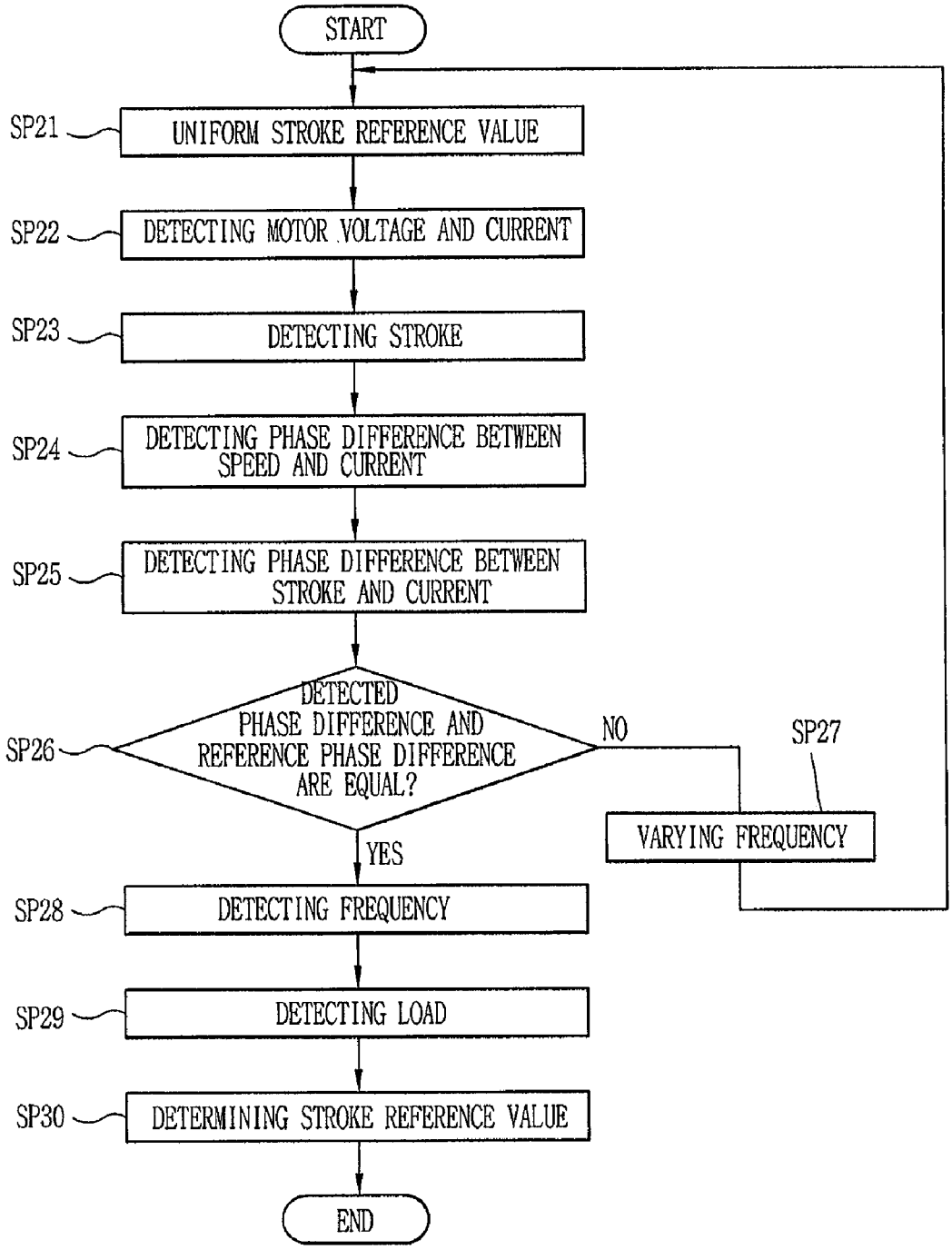
FIG. 6 is a flow chart illustrating the processes of a method for controlling an operation of the reciprocating compressor according to the present invention.

The operation of the present invention will now be described with reference to FIG. 6.

First, it is assumed that the reciprocating compressor is operated with a certain stroke reference value (SP21).

In this state, the current detecting unit 500 detects current of the motor of the reciprocating compressor, and the voltage detecting unit 600 detects voltage of the motor of the reciprocating compressor (SP22).

Thereafter, the stroke detecting unit 700 detects stroke by using the detected current and the detected voltage (SP23).

And then, the control unit 810 calculates speed of the motor of the reciprocating compressor by using the detected stroke (SP24).

Subsequently, the control unit 810 detects a phase difference between the calculated speed and the current (SP25), and outputs a frequency variable signal or a frequency detect signal based on the detected phase difference (SP26~SP30).

Namely, the control unit 800 compares the phase difference between the speed and the current with a reference phase difference (about 90°), and if the detected phase difference is not equal to the reference phase difference, the control unit 810 varies an operation frequency (SP27).

Here, if the phase difference between the detected speed and the current is greater than the reference phase difference, the control unit 810 reduces the operation frequency, whereas if the phase difference between the detected speed and the current is smaller than the reference phase difference, the control unit 810 increases the operation frequency.

In this case, the control unit 810 reduces the operation frequency by decreasing a duty rate of the PWM signal that switches a switching element (not shown) of the inverter 400, and increases the operation frequency by increasing the duty rate of the PWM signal.

Conversely, if the detected phase difference is equal to the reference phase difference, the control unit 810 detects a current operation frequency (SP28), and the load detecting unit 900 detects a size of a load according to the detected operation frequency (SP29).

Namely, the load detecting unit 900 detects a size of a load corresponding to the detected operation frequency from the storage unit (not shown) that stores loads corresponding to each operation frequency.

Thereafter, the stroke reference value determining unit 100 selects stroke corresponding to the size of the load from the stroke storage unit (not shown), and determines the selected stroke as the stroke reference value (SP30).

Namely, the stroke reference value determining unit 100 selects the stroke corresponding to the detected load from the storage unit (not shown) that previously stores the strokes corresponding to sizes of each load.

For example, if the load is determined as it is, the stroke reference value determining unit 100 selects stroke of a full cooling capacity, if the load is determined to be medium, the stroke reference value determining unit 100 selects stroke of 80% of the full cooling capacity, and if the load is determined to be small, the stroke reference value determining unit 100 selects stroke of 60% of full cooling capacity.

The comparator 200 obtains a difference value between the stroke reference value and the stroke, and the PWM signal generating unit 300 generates a PWM signal corresponding to the difference value and applies it to the inverter 400. Then, the inverter 400 varies frequency and voltage according to the PWM signal and applies it to the motor of the reciprocating compressor.

That is, in the present invention, the frequency is variably controlled to make a phase difference between the current and the speed uniform, the load is determined based on a size of a frequency at a point of time at which the phase difference between the current and the speed is uniformly maintained, and the operation capacity is varied according to the determined load, whereby the cooling capacity of an equipment employing an air-conditioning system (e.g., a refrigerator or an air-conditioner) can be easily varied.

As so far described, the apparatus and method for controlling the operation of the reciprocating compressor according to the present invention have many advantages.

That is, by variably controlling frequency to uniformly maintain the phase difference between the current and the stroke, the load is determined with the size of frequency at a point of time at which the phase difference between the current and the stroke is uniformly maintained, and the capacity is varied according to the determined load, thereby improving the operation efficiency of the compressor.

In addition, by variably controlling frequency to uniformly maintain the phase difference between the speed and the stroke, the load is determined with the size of frequency at a point of time at which the phase difference between the speed and the stroke is uniformly maintained, and the capacity is varied according to the determined load, thereby improving the operation efficiency of the compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An apparatus for controlling an operation of a reciprocating compressor, the apparatus comprising:

a current detector that detects a current applied to a motor;

a voltage detector that detects a voltage applied to the motor;

a stroke detector that detects a stroke based on the detected current and voltage;

a controller that calculates a current speed using the detected stroke and outputs a frequency variable signal or a frequency detect signal based on a phase difference between the calculated current speed and the detected current;

a load detector that detects a current operation load according to the frequency detect signal;

a stroke reference value determiner that determines a stroke reference value corresponding to the detected load;

a pulse width modulation signal generator that generates a pulse width modulation signal based on a difference between the determined stroke reference value and the detected stroke; and an inverter that varies a voltage and a frequency applied to the motor according to the generated pulse width modulation signal.

2. The apparatus of claim 1, wherein the load detector includes a storage device that stores respective load size values corresponding to respective frequency size values.

3. The apparatus of claim 1, wherein the stroke reference value determiner includes a stroke storage device that stores stroke values according to respective load size values.

4. The apparatus of claim 1, wherein when the frequency variable signal is inputted, the pulse width modulation signal generator generates the pulse width modulation signal for varying the frequency and the voltage applied to the motor according to the inputted frequency variable signal.

5. The apparatus of claim 1, wherein when the phase difference is equal to a reference phase difference, the controller outputs the frequency detect signal.

6. The apparatus of claim 5, wherein the reference phase difference is approximately 90°.

7. The apparatus of claim 1, wherein when the phase difference is not equal to a reference phase difference, the controller outputs the frequency variable signal.

8. The apparatus of claim 7, wherein the reference phase difference is approximately 90°.

9. A method for controlling an operation of a reciprocating compressor, the method comprising:

operating the reciprocating compressor at a capacity that corresponds to a predetermined stroke reference value;

detecting a voltage and a current applied to a motor and calculating a stroke using the detected voltage and the detected current;

calculating a speed using the calculated stroke and detecting a phase difference between the calculated speed and the detected current; and comparing the detected phase difference and a reference phase difference, and varying an operation capacity based on the comparison result.

10. The method of claim 9, wherein, in the varying the operation capacity, when the detected phase difference is not equal to the reference phase difference, an operation frequency is varied.

11. The method of claim 10, wherein, in the varying the operation frequency, when the detected phase difference is greater than the reference phase difference, the operation frequency is reduced, and when the detected phase difference is smaller than the reference phase difference, the operation frequency is increased.

12. The method of claim 11, wherein the operation frequency is reduced by decreasing a duty rate of a pulse width modulation signal, and wherein the operation frequency is increased by increasing the duty rate of the pulse width modulation signal.

13. The method of claim 9, wherein the varying the operation capacity comprises:

detecting a current operation frequency when the detected phase difference is equal to the reference phase difference;

detecting a size of a load according to the detected current operation frequency;

determining a stroke reference value corresponding to the detected size of the load;

generating a pulse width modulation signal based on a difference between the determined stroke reference value and the calculated stroke; and varying the operation capacity by controlling the voltage applied to the motor based on the generated pulse width modulation signal.

14. The method of claim 13, wherein, in the determining the stroke reference value, when the detected size of the load is large, the stroke reference value is determined to be a stroke value of a full cooling capacity; when the detected size of the load is medium, the stroke reference value is determined to be a stroke value of 80% of the full cooling capacity; and when the detected size of the load is small, the stroke reference value is determined to be a stroke value of 60% of the full cooling capacity.

15. The method of claim 9, wherein the reference phase difference is approximately 90°.

* * * * *